US011054777B2

(12) United States Patent
Nakajima

(10) Patent No.: US 11,054,777 B2
(45) Date of Patent: Jul. 6, 2021

(54) FIXING DEVICE HAVING A CONVEX PORTION ON SURFACE OF A HEATING UNIT, AND IMAGE FORMING APPARATUS PROVIDED WITH FIXING DEVICE

(71) Applicant: KYOCERA Document Solutions Inc., Osaka (JP)

(72) Inventor: Eiji Nakajima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/079,059

(22) Filed: Oct. 23, 2020

(65) Prior Publication Data

US 2021/0124295 A1 Apr. 29, 2021

(30) Foreign Application Priority Data

Oct. 23, 2019 (JP) ..... JP2019-192792

(51) Int. Cl.
*G03G 15/20* (2006.01)

(52) U.S. Cl.
CPC ..... *G03G 15/2053* (2013.01)

(58) Field of Classification Search
CPC ..... G03G 15/2017; G03G 15/2028; G03G 15/2053
USPC ..... 399/328, 329
See application file for complete search history.

(56) References Cited

U.S. PATENT DOCUMENTS 6,810,230 B2 * 10/2004 Imai et al. ..... G03G 15/2042 399/328
7,835,679 B2 * 11/2010 Baba et al. ..... G03G 15/2053 399/329
8,923,739 B2 * 12/2014 Gon ..... G03G 15/2053 399/328

FOREIGN PATENT DOCUMENTS

JP 2002-056963 A 2/2002
JP 2008-139455 A 6/2008
JP 2009-048916 A 3/2009

* cited by examiner

*Primary Examiner* — William J Royer
(74) *Attorney, Agent, or Firm* — Hawaii Patent Services; Nathaniel K. Fedde; Kenton N. Fedde

(57) ABSTRACT

Provided is a fixing device that makes it difficult for a sheet to adhere to a heating unit when the sheet is caught in a gap between the heating unit and a fixing member, and an image forming apparatus that includes the fixing device. The fixing device includes a fixing belt, a pressure roller, an IH heater, and convex portions. The fixing belt is rotatable. The pressure roller forms a pressure region in which the sheet is held and conveyed between the pressure roller and the fixing belt. The IH heater is such that the surface facing the outer peripheral surface of the fixing belt is formed in a shape along the outer peripheral surface, and the IH heater heats the fixing belt. The convex portions are formed on the surface of the IH heater facing the outer peripheral surface of the fixing belt.

9 Claims, 11 Drawing Sheets

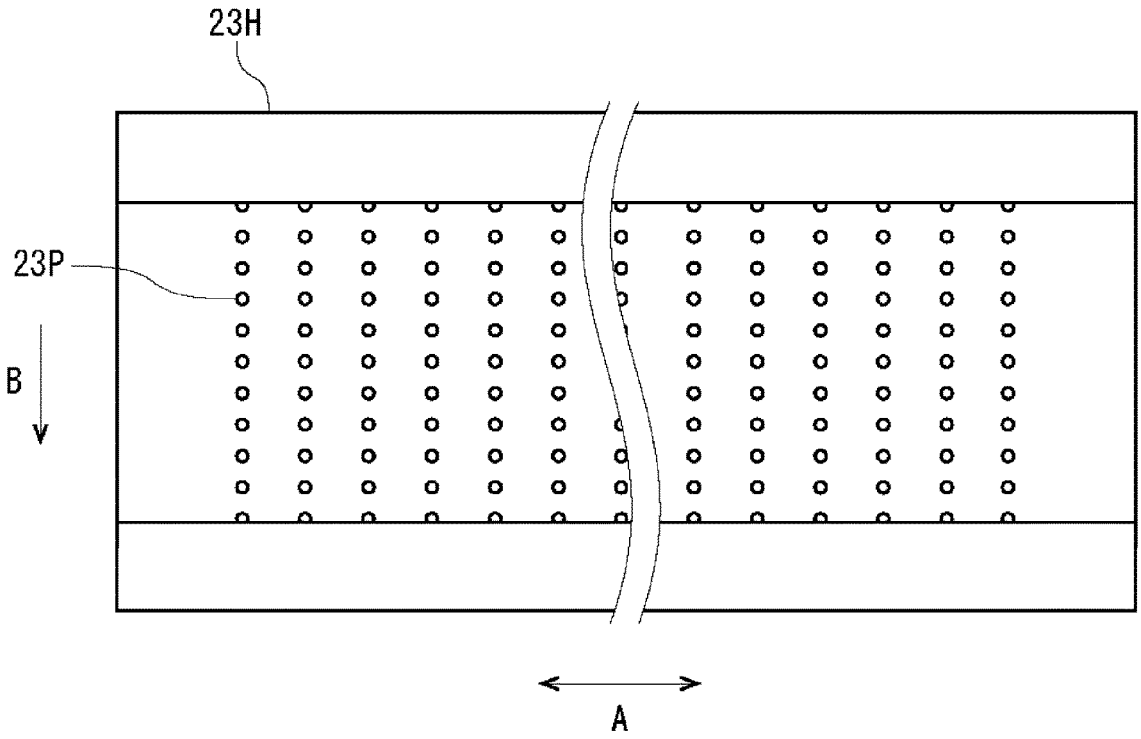
FIG.3
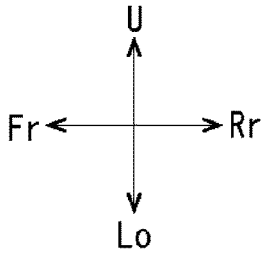

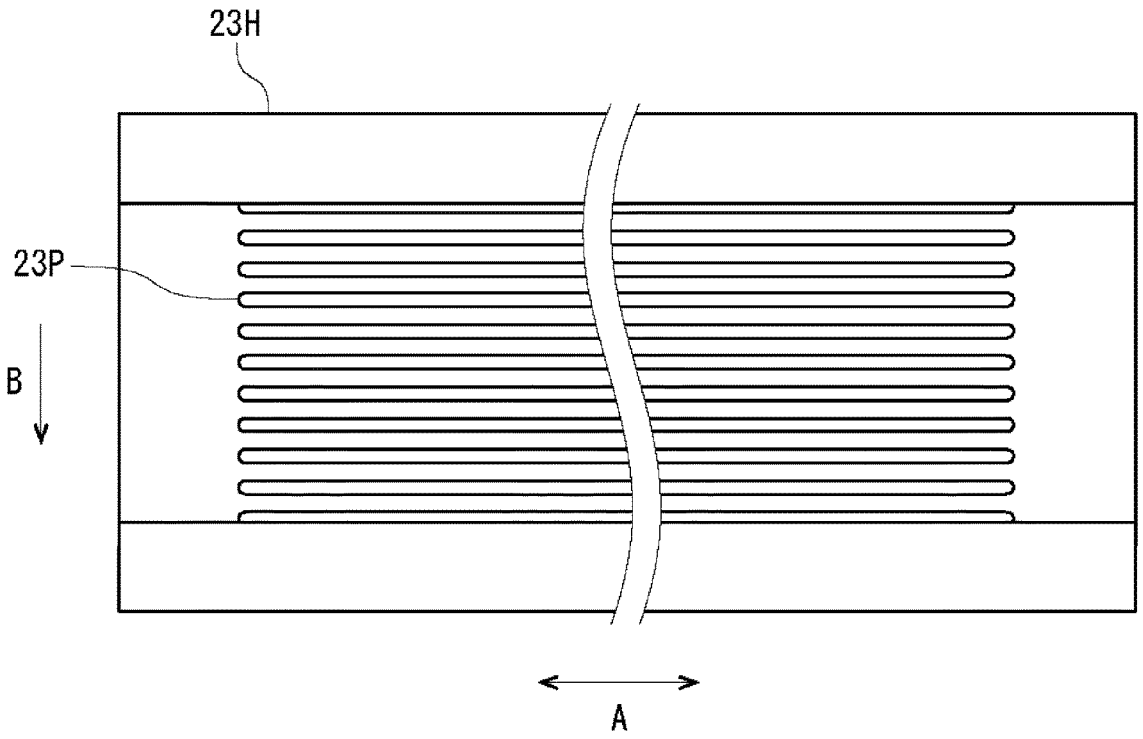
FIG.8
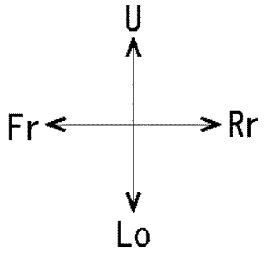

FIXING DEVICE HAVING A CONVEX PORTION ON SURFACE OF A HEATING UNIT, AND IMAGE FORMING APPARATUS PROVIDED WITH FIXING DEVICE

INCORPORATION BY REFERENCE

This application is based on and claims the benefit of priority from Japanese Patent Application No. 2019-192792 filed on Oct. 23, 2019, the contents of which are hereby incorporated by reference.

BACKGROUND

The present disclosure is related to a fixing device for fixing a toner image to a sheet, and an image forming apparatus provided with a fixing device.

A fixing device for raising a temperature of a fixing member by using an IH (Induction Heating) heater as a heating unit is known. An IH heater has advantages in that the heating rate is fast because of high heating efficiency, and the warm-up time can be shortened, and the environmental performance is also excellent. Typically, a belt-like or roller-shaped fixing member is used in which a coil for generating a magnetic field is held in a holder formed in a shape along the outer peripheral surface of the fixing member. A gap is formed between the holder and the fixing member.

SUMMARY

The fixing device according to the present disclosure includes a fixing member, a pressure roller, a heating unit, and convex portions. The fixing member is rotatable. The pressure roller forms a pressure region in which the sheet is held and conveyed between the pressure roller and the fixing member. The heating unit is such that a surface facing the outer peripheral surface of the fixing member is formed in a shape along the outer peripheral surface, and heats the fixing member. The convex portions are formed on the surface of the heating unit facing the outer peripheral surface of the fixing member.

BRIEF DESCRIPTION OF THE DRAWINGS

FIG. 3 is a right side view of a holder of an embodiment according to the present disclosure.

FIG. 8 is a right side view of a holder of a modification of an embodiment according to the present disclosure.

DETAILED DESCRIPTION

Hereinafter, a printer 1 (example of an image forming apparatus) and a fixing device 5 of an embodiment according to the present disclosure will be described with reference to the drawings.

Figure 1:
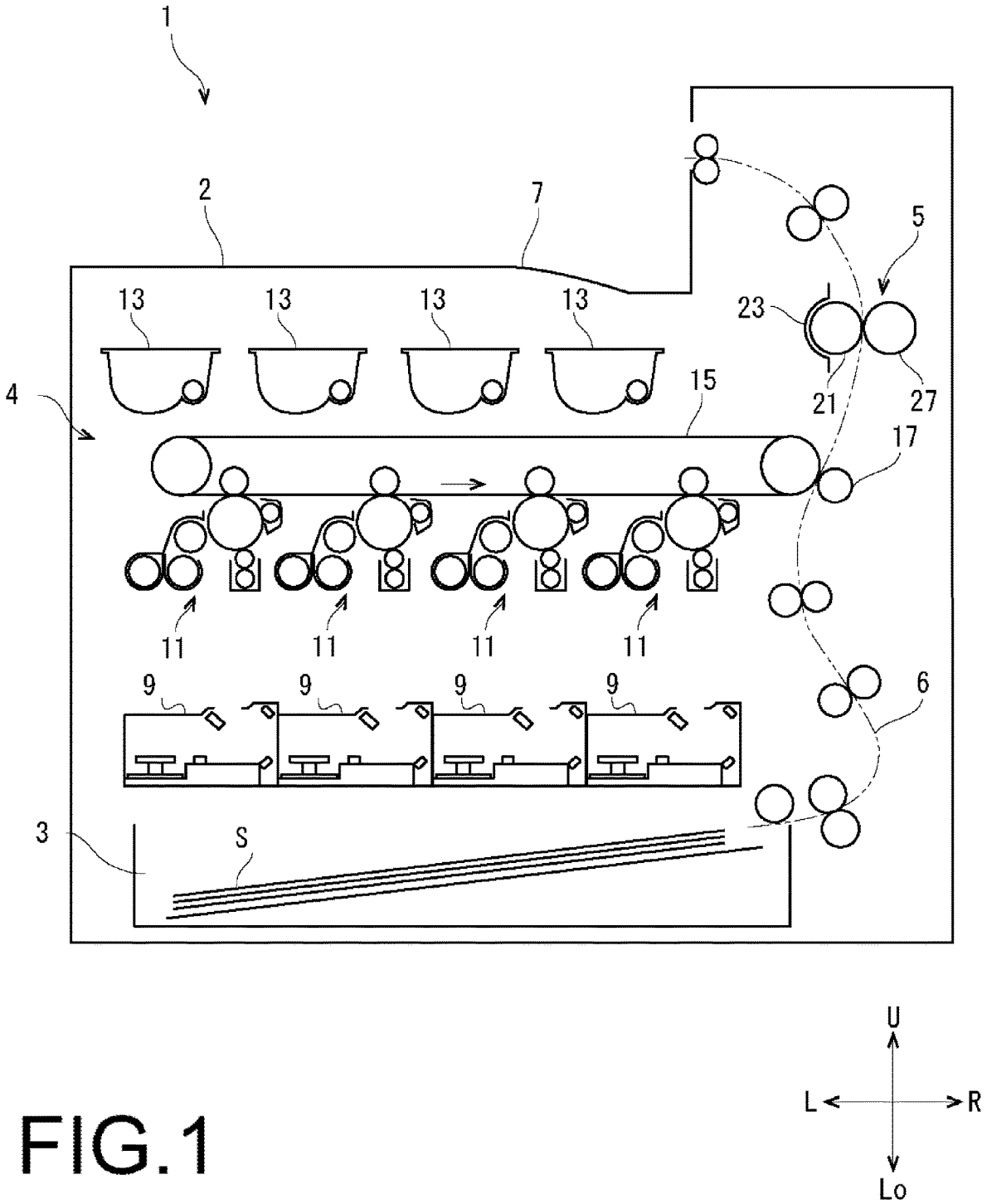
FIG. 1 is a front view schematically illustrating an internal configuration of a printer of an embodiment according to the present disclosure.

First, the overall configuration of the printer 1 will be described. FIG. 1 is a front view schematically illustrating the internal configuration of the printer 1. Hereinafter, the description will be based on the front side of the paper surface in FIG. 1 taken to be the front side of the printer 1 (front side), the left and right directions will be directions as viewed from the front side of the printer 1. In each figure, U, Lo, L, R, Fr, and Rr will refer to upper, lower, left, right, front, rear. respectively.

The printer 1 includes a box-shaped housing 2. The housing 2 houses a paper-supply device 3 for feeding sheets S to a conveying path 6, an image forming device 4 for forming a toner image on a sheet S, and a fixing device 5 for fixing a toner image to a sheet S. A discharge portion 7 to which a sheet S on which a toner image is fixed is discharged is formed in the upper portion of the housing 2.

The image forming device 4 includes a drum unit 11, an exposure device 9, a developer container 13, an intermediate transfer belt 15, and a secondary transfer roller 17. The drum unit 11 includes a photosensitive drum, a charging device, a developing device, a primary transfer roller, and a cleaning device. The photosensitive drum is rotated and driven. The charging device charges the photosensitive drum. The developing device forms a toner image by developing a latent image formed on the photosensitive drum by the exposure device 9 with a toner. The primary transfer roller transfers the toner image to the intermediate transfer belt 15. The cleaning device cleans the surface of the photosensitive drum. The exposure device 9 forms a latent image by irradiating a laser beam based on the image data onto the photosensitive drum. The developer container 13 houses developer that includes toner, and supplies the developer to the developing device. The intermediate transfer belt 15 is wound around a drive roller and a driven roller. The secondary transfer roller 17 transfers the toner image on the intermediate transfer belt 15 to the sheet S. The printer 1 includes four sets of a drum unit 11, an exposure device 9 and a developer container 13, and the four developer containers 13 house developer that includes toner of different colors from each other. Note that the technique according to the present disclosure may also be applied to a printer 1 that includes one to three sets or five or more sets of a drum unit 11, an exposure device 9 and a developer container 13.

When the printer 1 receives image data from an external computer or the like, a sheet S is fed out from the paper-supply device 3 to the conveying path 6, and latent images based on the image data are formed by the exposure devices 9 on the surfaces of the charged photosensitive drums. Toner images are formed on the photosensitive drums by the developing devices developing the latent images, then the toner images formed on the four photosensitive drums are transferred and overlaid onto the intermediate transfer belt 15 by the primary transfer rollers. The toner image on the intermediate transfer belt 15 is transferred to the sheet S by the secondary transfer roller 17, fixed to the sheet S by the fixing device 5. The sheet S on which the toner image is fixed is discharged to the discharge portion 7.

Figure 2:
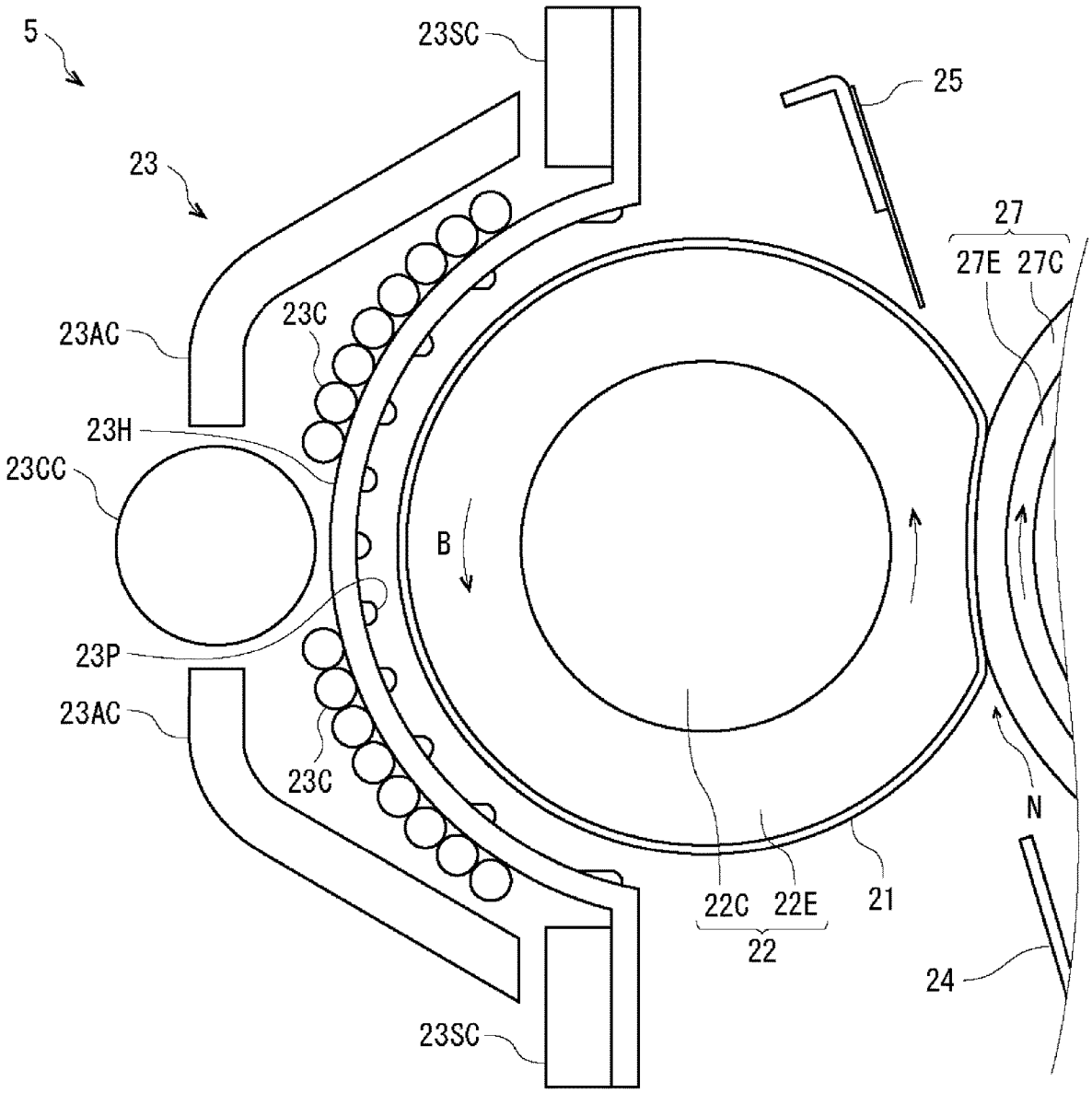
FIG. 2 is a cross-sectional view of a fixing device of an embodiment according to the present disclosure.
Figure 2:
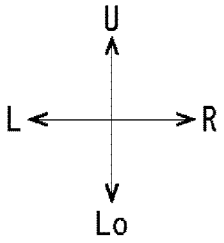

Next, the configuration of the fixing device 5 will be described with reference to FIG. 2 and FIG. 3. FIG. 2 is a cross-sectional view of the fixing device 5. FIG. 3 is a right side view of a holder 2311.

The fixing device 5 includes a fixing belt 21 (an example of a fixing member), a pressure roller 27, an Ill heater 23 (an example of a heating unit), and convex portions 23P. The fixing belt 21 is rotatable. The pressure roller 27 forms a pressure region N where a sheet S is held and conveyed between the pressure roller 27 and the fixing belt 21. The Ill heater 23 is such that the surface facing the outer peripheral surface of the fixing belt 21 is formed in a shape along the outer peripheral surface, and the Ill heater 23 heats the fixing belt 21. The convex portions 23P are formed on the surface of the Ill heater 23 facing the outer peripheral surface of the fixing belt 21. Note that in the present embodiment, an example is given of a fixing device 5 that is arranged in a posture in which the pressure roller 27 is located to the right of the fixing belt 21; however, the fixing device 5 may be arranged in any posture.

[Fixing Belt]

The fixing belt 21 is an endless belt formed in a cylindrical shape with the front and rear directions taken to be the longitudinal direction, and the fixing belt 21 is provided so as to cover the outer peripheral surface of a fixing roller 22. The fixing belt 21 includes a base layer, an elastic layer formed on the outer peripheral surface of the base layer, and a release layer formed on the outer peripheral surface of the elastic layer. The base layer is formed of a magnetic alloy such as Ni or the like, or a polyimide resin mixed with a metal powder such as Cu, Ag, Al, or the like. The elastic layer is formed of silicone rubber or the like. The release layer is formed of a PFA (tetrafluoroethylene/perfluoroalkoxy ethylene copolymer resin) tube or the like. An example of the layer thickness of each layer is 30 μm for the base layer (in the case of Ni alloy), 200 μm for the elastic layer, and 50 μm for the release layer.

[Fixing Roller]

The fixing roller 22, the front-rear direction of which is taken to be the longitudinal direction, includes a metal core 22C and an elastic layer 22E formed on the outer peripheral surface of the metal core 22C. The metal core 22C is made of an Al alloy or the like. The elastic layer 22E is formed of a foam-based silicone rubber or the like. The fixing belt 21, together with the fixing roller 22, is rotatable around the axis of the fixing roller 22.

[Pressure Roller]

The pressure roller 27, the front-rear direction of which is taken to be the longitudinal direction, includes a metal core 27C, an elastic layer 27E formed on the outer peripheral surface of the metal core 27C, and a release layer formed on the outer peripheral surface of the elastic layer 27E. The metal core 27C is made of an Al alloy or the like. The elastic layer 27E is formed of silicone rubber or the like. The release layer is formed of a PFA tube or the like. The layer thickness of the elastic layer 27E, for example, is 50 μm. The pressure roller 27 is pressed against the fixing belt 21 by a biasing mechanism using a spring or the like. As a result, a part of the elastic layer 22E of the fixing roller 22 and the elastic layer 27E of the pressure roller 27 is pushed down, and a pressure region N (nip region) is formed between the fixing belt 21 and the pressure roller 27. The pressure roller 27 is driven by a drive source such as a motor or the like, and the fixing belt 21 and the fixing roller 22 rotate following the rotation of the pressure roller 27.

[IH Heater]

IH heater 23 includes a holder 23H, a coil 23C, a side core 23SC, a center core 23CC, and an arch core 23AC.

[Holder]

Holder 23H is arranged so as to face the outer peripheral surface of the left side portion of the fixing belt 21. The surface of the holder 23H facing the outer peripheral surface of the fixing belt 21 is formed in a shape along the outer peripheral surface of the fixing belt 21, and has a gap (for example, about 3 mm) having a substantially constant distance from the outer peripheral surface of the fixing belt 21 is formed so as to face the fixing belt 21. The holder 23H is formed by using a heat-resistant resin such as a liquid crystal polymer or the like. Hereinafter, for convenience, the concave surface on the right side of the holder 23H (the surface facing the outer peripheral surface of the fixing belt 21) is referred to as the inner surface, and the convex surface on the left side of the holder 23H is referred to as the outer surface.

[Convex Portions]

A plurality of convex portions 23P is formed on the inner surface of the holder 23H. As illustrated in FIG. 3, as viewed from the right, the convex portions 23P are formed at equal intervals in a plurality of locations in the rotational direction B of the fixing belt 21, and are formed at equal intervals in a plurality of locations in the axial direction A (front-rear-direction) of the pressure roller 27. The distance between the plurality of convex portions 23P in the rotation direction B is, for example, about 5 mm. The distance between the plurality of convex portions 23P in the axial direction A is, for example, about 10 mm. As illustrated in FIG. 2, the surfaces of the plurality of convex portions 23P form a curved surface protruding toward the fixing belt 21 side. In the central portion in the vertical direction of the inner surface of the holder 23H, the surfaces of the convex portions 23P are substantially hemispherical; however, in a case of forming the holder 23H by injection-molding, in order to be able to pull out the mold on the inner surface side toward the right in FIG. 2, the convex portions 23P are shaped so as to extend in the left-right direction the closer to both the upper and lower end portions of the inner surface. The height of the convex portions 23P from the inner surface of the holder 2311 is, for example, about 1 mm.

[Coils, Cores]

The coil 23C is formed in a spiral shape that is long in the front-rear direction along the outer surface of the holder 2311, and is supported by the outer surface of the holder 2311. The side core 23SC, the center core 23CC, and the arch core 23AC are formed by using a ferromagnetic material such as ferrite or the like, and form a magnetic path through which a magnetic flux generated from the coil 23C passes. The side core 23SC is formed in a rod shape with the front-rear direction as the longitudinal direction, and is provided at both the upper and lower end portions of the holder 2311. Center core 23CC is formed in a rod shape with the front-rear direction as the longitudinal direction, and faces the outer surface of the holder 2311 at the center of the holder 2311 in the vertical direction. When viewed from the left, the coil 23C is spirally wound around the center core 23CC. A curved rod-shaped arch core 23AC spans between the upper side core 23SC and the center core 23CC, and a curved rod-shaped arch core 23AC spans between the lower side core 23SC and the center core 23CC. The arch cores 23AC are provided at a plurality of locations in the front-rear direction at intervals from each other. The coil 23C receives electric power from the power source to generate a magnetic field. Due to this magnetic field, a current due to electromagnetic induction flows through the base layer of the fixing belt 21, and generates Joule heat.

[Guide Member]

A guide member 24 is provided on the upstream side in the conveying direction of the sheet S with respect to the pressure region N. The guide member 24 is a plate-shaped member and guides the sheet S conveyed from the image forming device 4 to the pressure region N.

[Separating Member]

A separating member 25 is provided further on the downstream side in the conveying direction of the sheet S than the pressure region N. The separating member 25 is a plate-like member, and a gap is formed between the tip end portion of the fixing belt 21 side of the separating member 25 and the fixing belt 21. The size of the gap, for example, is about 0.3 mm. The separating member 25, by guiding the tip end portion of the sheet S that is conveyed from the pressure region N along the right surface of the separating member 25, promotes separation of the sheet S from the fixing belt 21.

Figure 4:
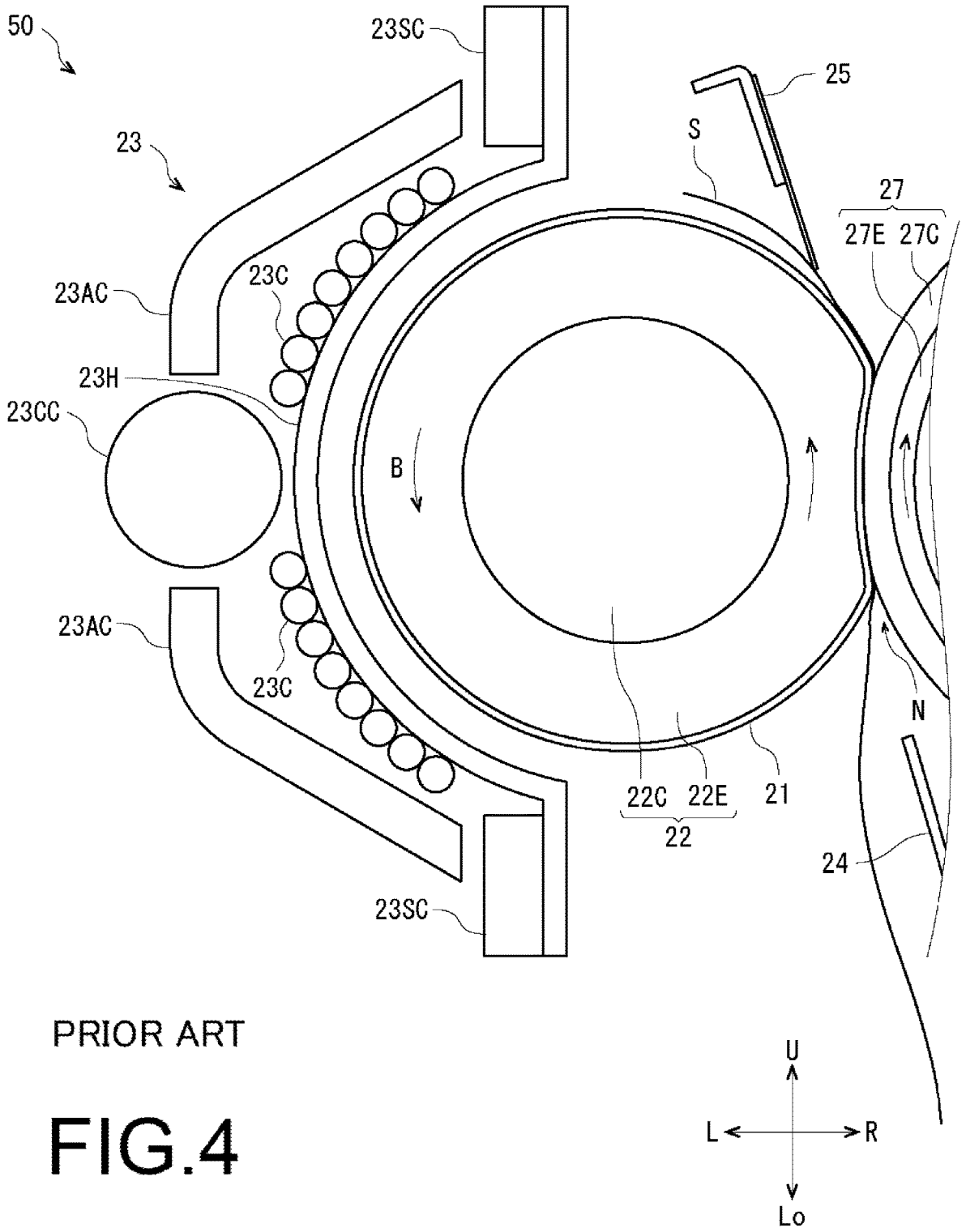
PRIOR ART FIG.4
FIG. 4 is a cross-sectional view illustrating the state of sheet clogging in a conventional fixing device.
Figure 5:
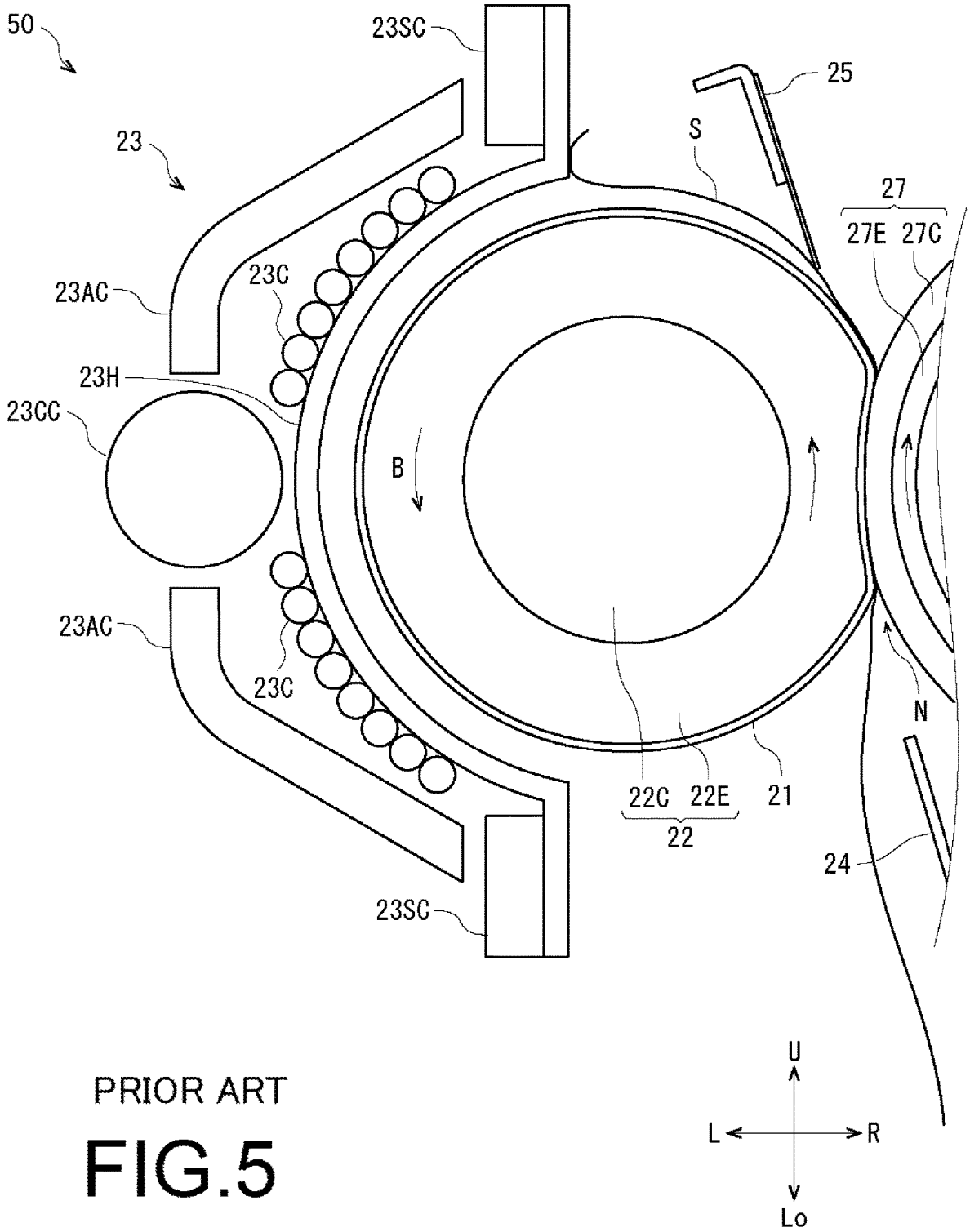
PRIOR ART FIG.5
FIG. 5 is a cross-sectional view illustrating the state of sheet clogging in a conventional fixing device.
Figure 6:
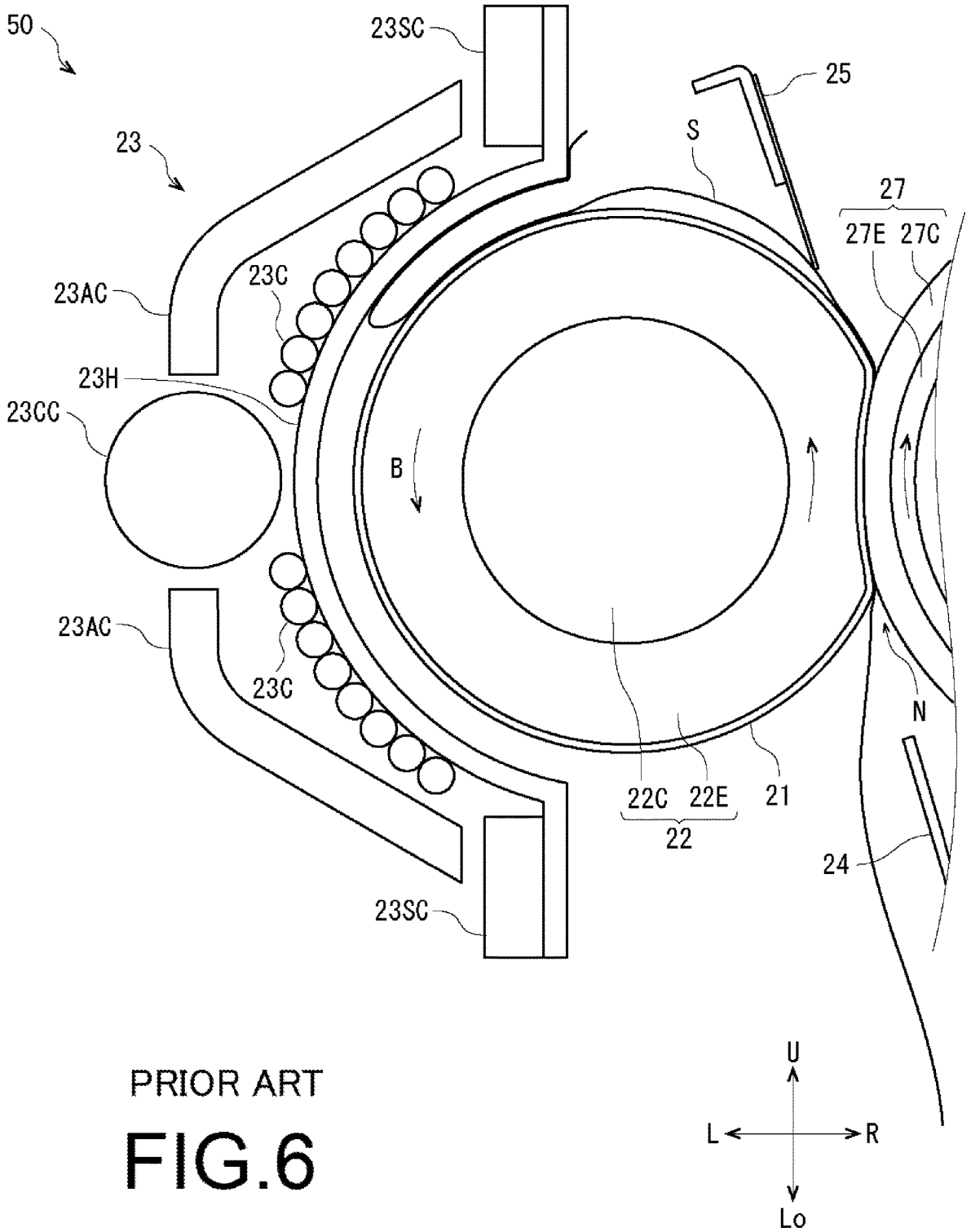
PRIOR ART FIG.6
FIG. 6 is a cross-sectional view illustrating the state of sheet clogging in a conventional fixing device.

Here, sheet clogging in a conventional fixing device 50 will be described with reference to FIG. 4 to FIG. 6. FIG. 4 to FIG. 6 are cross-sectional views illustrated a state of sheet clogging in a conventional fixing device 50. In the illustrated fixing device 50, the convex portions 23P are omitted from the fixing device 5 according to the present embodiment.

In a case where there is very little margin on the tip end side of the sheet S (end portion on the downstream side in the conveying direction), and the image has a large area of toner, it becomes easy for the sheet S to adhere to the fixing belt 21. In a case where the sheet is skewed, the substantial margin is further reduced, so the sheet S is more likely to adhere. Therefore, the sheet S adhering to the fixing belt 21 may pass through the gap between the separating member 25 and the fixing belt 21 (see FIG. 4). Then, the tip end portion of the sheet S that is about to be peeled off may come into contact with the end portion on the upstream side in the rotation direction B of the holder 23H and block the path (see FIG. 5). Then, the subsequent portion of the sheet S may be caught in the gap between the holder 23H and the fixing belt 21 (see FIG. 6). The holder 23H is made of resin and so has low releasability, and the sheet S easily adheres due to the adhesive force of the molten toner. Then, when the heat is taken away by the holder 2311, the toner is solidified, and the sheet S adheres to the holder 2311. After that, even if the user tries to remove the sheet S, the sheet S is torn and remains in the holder 2311.

Figure 7:
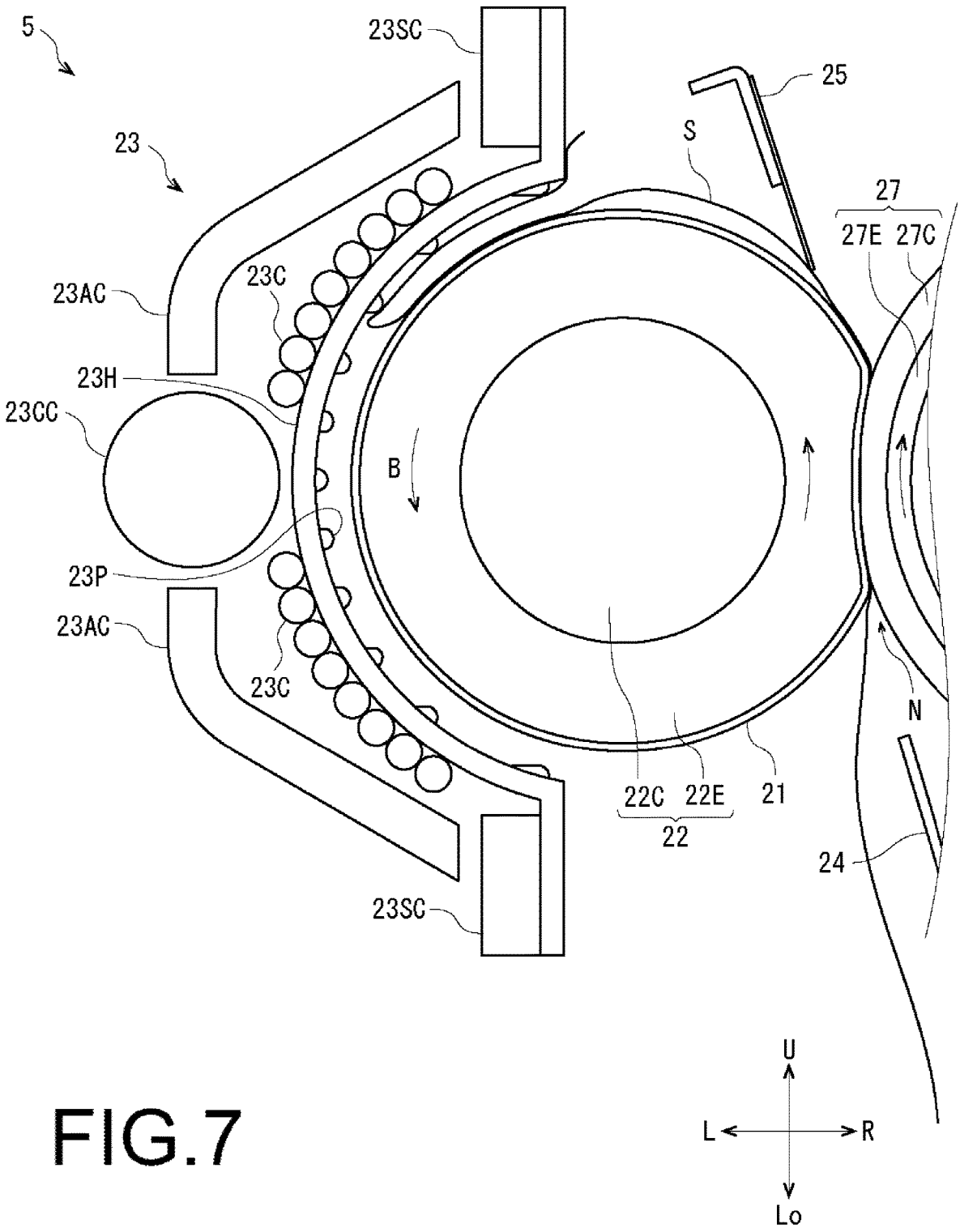
FIG. 7 is a cross-sectional view illustrating the state of sheet clogging in a fixing device of an embodiment according to the present disclosure.

Next, sheet clogging in the fixing device 5 according to the present embodiment will be described with reference to FIG. 7. FIG. 7 is a cross-sectional view illustrating the state of sheet clogging in the fixing device 5. In a case where the sheet S is caught in the gap between the holder 2311 and the fixing belt 21 as illustrated in FIGS. 4 to 6, the caught sheet S comes into contact with the plurality of convex portions 23P formed on the inner surface of the holder 2311, so it becomes difficult for the sheet S to come into contact with the inner surface of the holder 2311. Therefore, compared with a case where the plurality of convex portions 23P are not provided, the sheet S is less likely to adhere to the holder 2311. Moreover, even supposing that the toner in contact with the plurality of convex portions 23P is solidified, the amount of the solidified toner is smaller than that in the case where the plurality of convex portions 23P are not provided, so that the sheet S can be easily peeled off.

With the fixing device 5 according to the present embodiment described above, in a case where the sheet S is caught in the gap between the holder 23H of the IH heater 23 and the fixing belt 21, it is possible to make it difficult for the sheet S to adhere to the holder 2311.

In addition, convex portions 23P are formed at a plurality of location in the rotation direction B and at a plurality of location in the axial direction A, so it becomes difficult for the sheet S to adhere to the holder 2311 over the entire area of the inner surface of the holder 2311.

Furthermore, the convex portions 23P are formed at a plurality of locations in the rotation direction B, so it is difficult for the sheet S caught in the gap between the holder 2311 and the fixing belt 21 to enter the inner side of the gap (downstream side in the rotation direction B), and thus the sheet S can be easily removed.

Moreover, the surfaces of the plurality of convex portions 23P form a curved surface that bulges toward the fixing belt 21 side, so the contact between the sheet S and the convex portions 23P is a point contact. Therefore, the sheet S is less likely to adhere to the convex portions 23P as compared with the case where the sheet S makes line contact or surface contact with the convex portions 23P.

The above embodiment may be modified as follows.

In the embodiment described above, an example is illustrated in which the surfaces of the convex portions 23P form a curved surface protruding toward the fixing belt 21; however, the surfaces of the convex portions 23P may form a conical surface protruding toward the fixing belt 21 side. The conical surface is, for example, a side surface of a cone, a pyramid, or the like. With this configuration, the contact between the sheet S and the convex portions 23P is point contact, so the same effect as the above embodiment is obtained.

Furthermore, the convex portions 23P may be formed linearly along the inner surface of the holder 2311 like a reinforcing rib of a structural material. For example, the convex portions 23P may be formed linearly in the axial direction A (see FIG. 8), may be formed linearly in the rotation direction B, or may be formed linearly in any other direction. Further, the contour of the vertical cross-section of the linear convex portion 23P may form a curved or wedge-shaped line projecting on the fixing belt 21 side. With this configuration, the contact between the sheet S and the convex portions 23P is line contact, so that an effect close to that of the above embodiment may be obtained. In addition, in a case where the convex portions 23P are formed linearly in the axial direction A, it becomes difficult for the sheet S caught in the gap between the holder 2311 and the fixing belt 21 to enter the inner side of the gap (downstream side in the rotation direction B), so the sheet S can be easily removed.

Figure 9A:
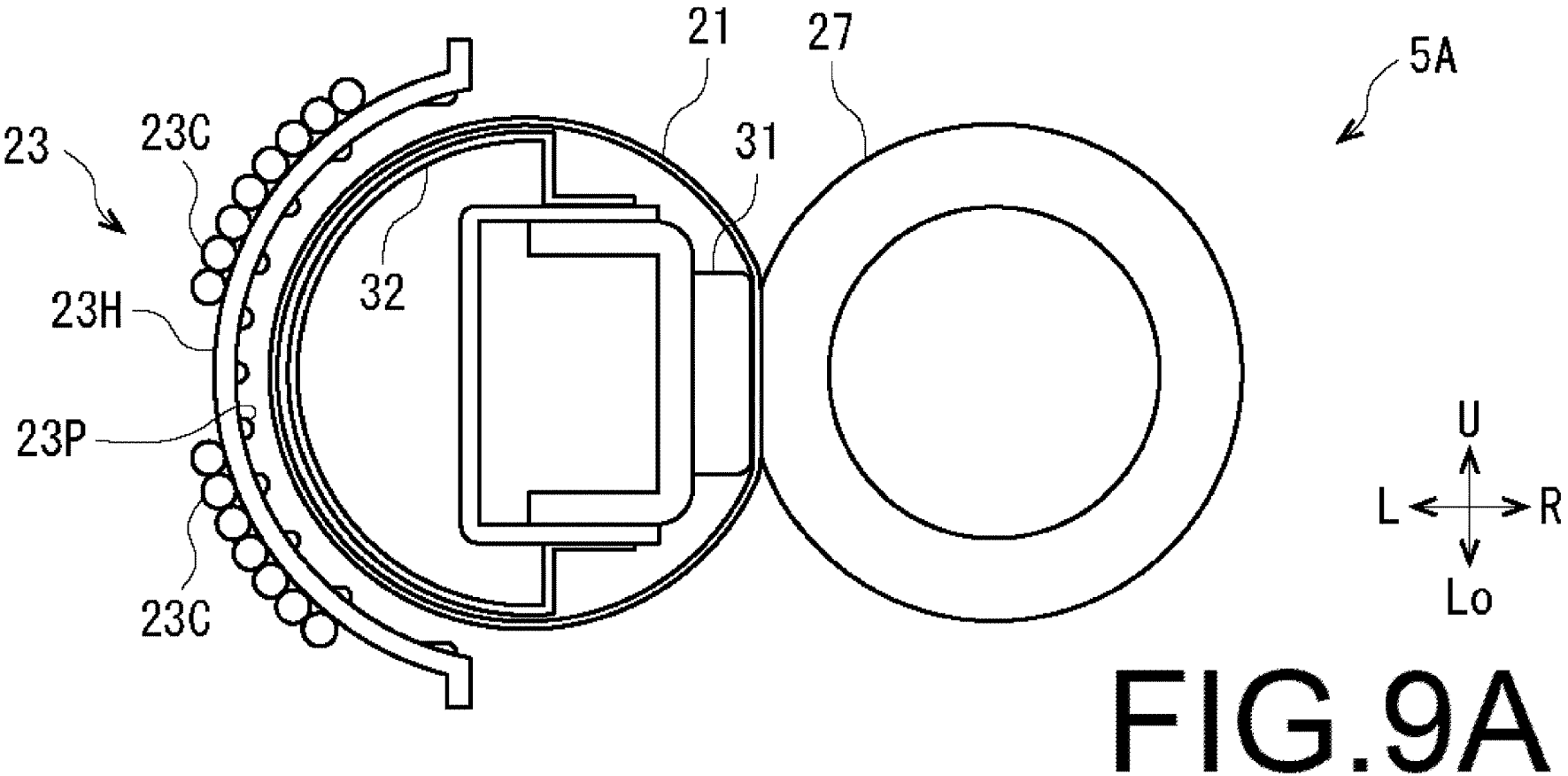
FIG. 9A is a cross-sectional view of a fixing device of a modification of an embodiment according to the present disclosure.
Figure 9B:
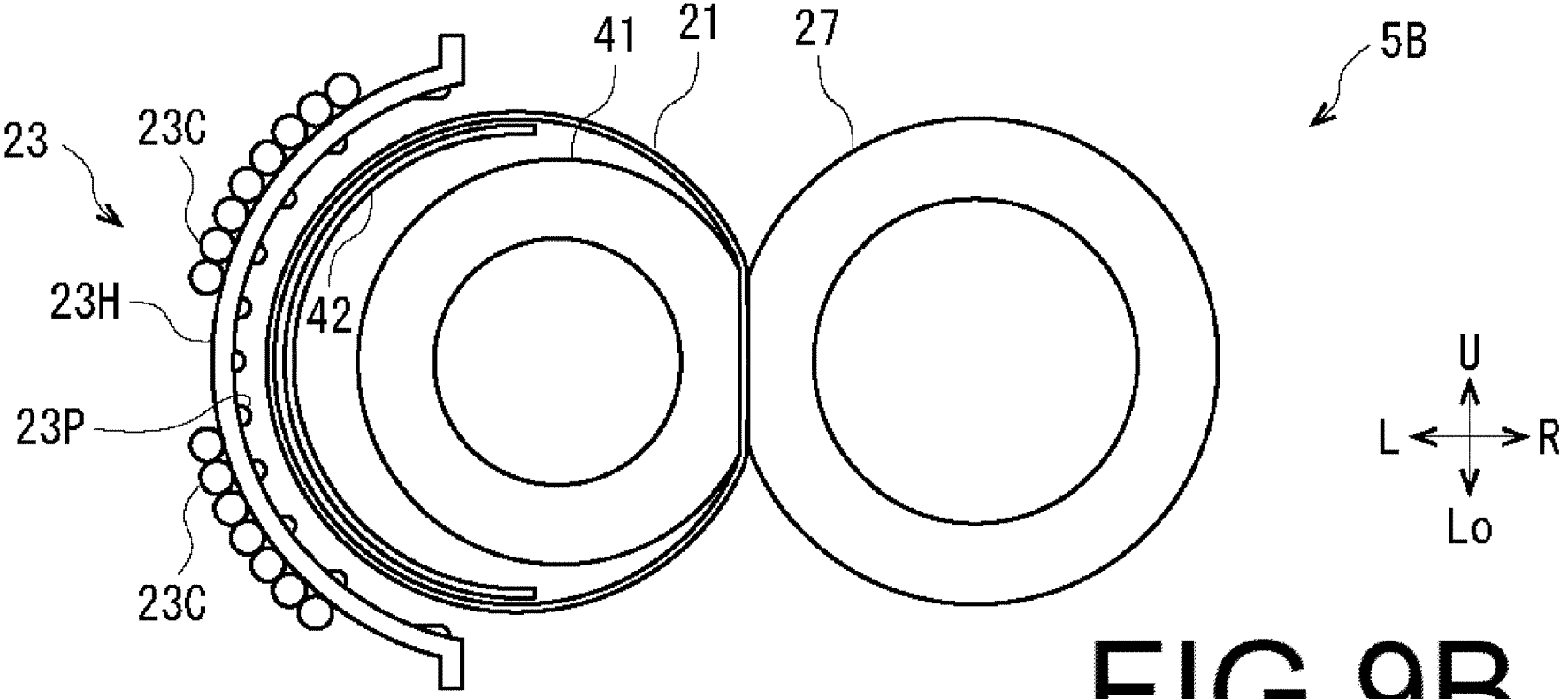
FIG. 9B is a cross-sectional view of a fixing device of a modification of an embodiment according to the present disclosure.
Figure 9C:
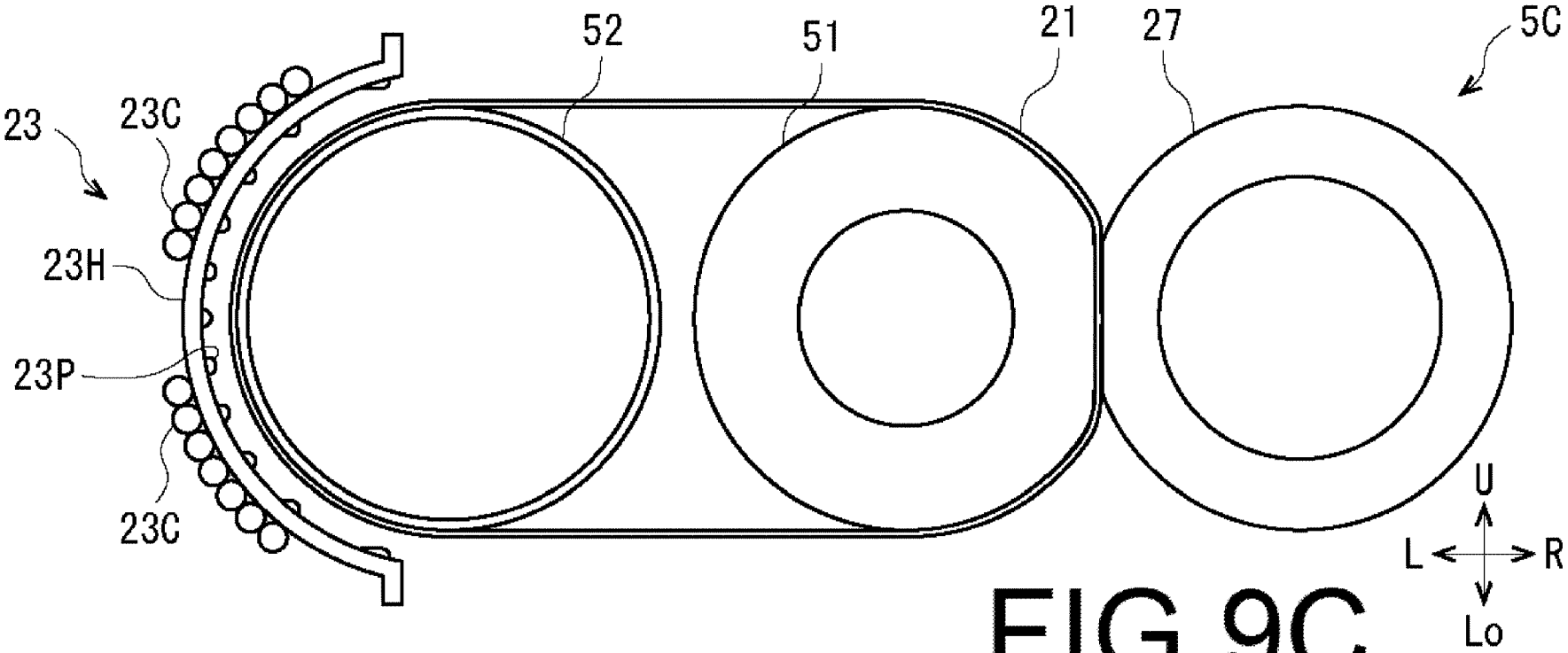
FIG. 9C is a cross-sectional view of a fixing device of a modification of an embodiment according to the present disclosure.

In the embodiment described above, an example in which the present disclosure is applied to the fixing device 5 provided so that the fixing belt 21 covers the outer peripheral surface of the fixing roller 22 is illustrated; however, for example, the technique of the present disclosure may also be applied to the fixing devices 5A to 5C illustrated in FIGS. 9A to 9C.

The fixing device 5A illustrated in FIG. 9A includes a tubular fixing belt 21, a pressing member 31, a pressure roller 27, an IH heater 23, and a support member 32. The pressing member 31 is provided on the inner peripheral surface side of the fixing belt 21. The pressure roller 27 holds the fixing belt 21 between the pressure roller 27 and the pressing member 31, and forms a pressure region N in which the sheet S between the pressure roller 27 and the fixing belt 21 is held and conveyed. The IH heater 23 faces the outer peripheral surface of the fixing belt 21 and heats the fixing belt 21. A support member 32 comes in contact with the inner peripheral surface of the fixing belt 21 and supports the fixing belt 21.

The fixing device 5B illustrated in FIG. 9B includes a tubular fixing belt 21, a pressing roller 41, a pressure roller 27, an IH heater 23, and a support member 42. The pressing roller 41 has an outer diameter smaller than the inner diameter of the fixing belt 21, and is provided on the inner peripheral surface side of the fixing belt 21. The pressure roller 27 holds the fixing belt 21 between the pressure roller 27 and the pressing roller 41, and forms a pressure region N in which the sheet S between the pressure roller 27 and the fixing belt 21 is held and conveyed. The IH heater 23 faces the outer peripheral surface of the fixing belt 21 and heats the fixing belt 21. A support member 42 comes in contact with the inner peripheral surface of the fixing belt 21 and supports the fixing belt 21.

The fixing device 5C illustrated in FIG. 9C includes a pressing roller 51, a support roller 52, a tubular fixing belt 21, a pressure roller 27, and an IH heater 23. Tubular fixing belt 21 is wound around the pressing roller 51 and the support roller 52. The pressure roller 27 holds the fixing belt 21 between the pressure roller 27 and the pressing roller 51, and forms a pressure region N in which the sheet S between the pressure roller 27 and the fixing belt 21 is held and conveyed. The IH heater 23 faces the outer peripheral surface of the fixing belt 21 and heats the fixing belt 21.

The IH heater 23 provided in the fixing devices 5A, 5B, and 5C includes a coil 23C, a holder 2311, and convex portions 23P similar to those in the embodiment described above. With these configurations, the same effect as that of the embodiment described above may be obtained.

In the embodiment described above, an example is illustrated in which a plurality of convex portions 23P are formed at equal intervals in the rotation direction B of the fixing belt 21 and at equal intervals in the axial direction A of the pressure roller 27; however, the intervals between the plurality of convex portions 23P do not have to be equal. For example, the frequency at which a caught sheet S reaches the gap downstream of the holder 2311 and the fixing belt 21 in the rotation direction B decreases, so the intervals between the plurality of convex portions 23P in the rotation direction B may be increased toward the downstream side in the rotation direction B. In addition, when a plurality of types of sheets S having different sizes in the axial direction A is different is used, the frequency at which the sheets S pass decreases as the distance from the central portion in the axial direction A increases. Furthermore, margins are set at both end portions of the sheet S in the axial direction A, so the probability that toner is present on the sheet S decreases as the distance from the central portion in the axial direction A increases. Therefore, the distance between the plurality of convex portions 23P in the axial direction A may increase as the distance from the central portion in the axial direction A increases.

In the embodiment described above, an example in which a plurality of convex portions 23P are formed at positions corresponding to the lattice points of a rectangular lattice when viewed from the right is illustrated; however, the plurality of convex portions 23P may also be formed at positions corresponding to the grid points of an orthorhombic grid or a hexagonal grid. Additionally, the plurality of convex portions 23P may be formed in an irregular arrangement. With these configurations as well, the same effect as that of the embodiment described above may be obtained.

In the embodiment described above, an example in which a plurality of convex portions 23P is formed on the inner surface of the holder 23H is illustrated; however, it is also possible to form only one convex portion 23P on the inner surface of the holder 23H. For example, one rib-shaped convex portion 23P formed in a zigzag shape may be formed. With this configuration as well, an effect close to that of the embodiment described above may be obtained.

In the embodiment described above, an example in which the present disclosure is applied to a fixing device 5 including the separating member 25 is shown; however, the present disclosure may also be applied to a fixing device 5 that does not include the separating member 25.

In the embodiment described above, an example is illustrated in which the present disclosure is applied to a fixing device 5 including an III heater 23 in which a coil 23C is held in a holder 23H as a heating unit. However, instead of the III heater 23, the present disclosure may be applied to a fixing device 5 having a heating unit in which a heat source such as a halogen heater, a carbon heater or the like is held in the holder 23H.

In a fixing device of a typical technique, a pressure roller is pressed against a fixing member to form a pressure region (nip region), and holding and conveying a sheet in the pressure region, the toner is pressurized, melted and a fixed to the sheet. However, since the molten toner has adhesive strength, the sheet may adhere to the fixing member. Therefore, a plate-shaped separating member with the tip end portion thereof facing the fixing member is provided further on the downstream side in the conveying direction than the pressure region. A fixing member covered with a fluororesin release layer may be used to improve the releasability; however, when the separating member is brought into contact with the release layer, the release layer may be damaged, so the separating member is arranged with a gap between the separating member and the fixing member.

However, in a case where there is less margin on the tip end side of the sheet and the image has a large area of toner, the sheet is likely to adhere to the fixing member. In a case where the sheet is skewed, the substantial margin is further reduced, so the sheet is more likely to adhere. Therefore, the sheet adhered to the fixing member passes through the gap between the separating member and the fixing member, the tip end portion of the sheet that is about to peel off comes into contact with the end of the holder and blocks the path, and the subsequent part of the sheet may get caught in the gap between the holder and the fixing member. The holder is made of resin and so has low releasability, and the sheet S easily adheres due to the adhesive force of the molten toner. Then, when the heat is taken away by the holder, the toner is solidified, and the sheet adheres to the holder. After that, even though the user tries to remove the sheet, the sheet may be torn and remain in the holder. It is difficult for a normal user to remove the sheet adhered to the holder, so it becomes necessary to make a request to a repair person, and the printer cannot be used until the work by the repair person is complete.

According to the present disclosure, when a sheet is caught in the gap between the heating unit and the fixing member, it is possible to prevent the sheet from adhering to the heating unit.

What is claimed is:

1. A fixing device comprising:

a rotatable fixing member;

a pressure roller that forms a pressure region in which a sheet is held and conveyed between the pressure roller and the fixing member;

a heating unit, a surface thereof facing an outer peripheral surface of the fixing member is formed in a shape along the outer peripheral surface, and heats the fixing member; and a convex portion formed on the surface of the heating unit facing the outer peripheral surface of the fixing member.

2. The fixing device according to claim 1, wherein convex portions are formed at a plurality of locations in a rotation direction of the fixing member.

3. The fixing device according to claim 1, wherein convex portions are formed at a plurality of locations in an axial direction of the pressure roller.

4. The fixing device according to claim 1, wherein the surface of the convex portion forms a curved surface or a conical surface protruding toward the fixing member.

5. The fixing device according to claim 1, wherein the convex portion is formed linearly along a surface of the heating unit facing the outer peripheral surface of the fixing member.

6. The fixing device according to claim 5, wherein the convex portion is formed linearly in the axial direction of the pressure roller.

7. The fixing device according to claim 5, wherein a contour of a cross section of the linearly convex portion in a longitudinal direction forms a curved line or a wedge-shaped line protruding toward the fixing member.

8. The fixing device according to claim 1, wherein the heating unit comprises:

a coil that generates a magnetic field; and a holder having a surface facing the outer peripheral surface of the fixing member formed in a shape along the outer peripheral surface and holding the coil; and the convex portion is formed on a surface of the holder facing the outer peripheral surface of the fixing member.

9. An image forming apparatus, comprising:

an image forming device for forming a toner image on the sheet; and a fixing device according to claim 1 that fixes the formed toner image to the sheet.

* * * * *